US006119595A

United States Patent [19]

Garris et al.

[11] Patent Number: 6,119,595

[45] Date of Patent: Sep. 19, 2000

[54] GRAVURE PRINTING PRESS WITH ENCAPSULATED INK APPLICATOR AND METHOD

[75] Inventors: William Earl Garris; Donald Ellis Williams, both of Winston-Salem, N.C.

[73] Assignee: R. J. Reynolds Tobacco Company, Winston-Salem, N.C.

[21] Appl. No.: 08/944,168

[22] Filed: Oct. 6, 1997

[51] Int. Cl.[7] ..... B41F 31/05

[52] U.S. Cl. ..... 101/366; 101/365

[58] Field of Search ..... 101/366, 365, 101/157; 427/428

[56] References Cited

U.S. PATENT DOCUMENTS

| | | | |
|---|---|---|---|
| Re. 30,819 | 12/1981 | Schaeuble | 427/345 |
| 2,018,193 | 10/1935 | Smith | 101/157 |
| 2,151,968 | 3/1939 | Henderson | 101/157 |
| 2,377,110 | 5/1945 | Smith | 101/157 |
| 2,630,065 | 3/1953 | Caulfield | 101/157 |
| 3,986,453 | 10/1976 | Bööse | 101/169 |
| 4,066,014 | 1/1978 | van Haaften | 101/157 |
| 4,077,317 | 3/1978 | Kiesewetter et al. | 101/37 |
| 4,085,672 | 4/1978 | Grosart | 101/169 |
| 4,327,662 | 5/1982 | Damrau | 118/410 |
| 4,444,102 | 4/1984 | Clark et al. | 101/36 |
| 4,461,211 | 7/1984 | Wesselmann et al. | 101/366 |
| 4,497,250 | 2/1985 | Dressler | 101/366 |
| 4,590,855 | 5/1986 | Schommer et al. | 101/157 |
| 4,699,056 | 10/1987 | Beck | 101/366 |
| 4,821,672 | 4/1989 | Bruno | 101/366 |
| 4,945,832 | 8/1990 | Odom | 101/350 |
| 4,964,336 | 10/1990 | Bock et al. | 101/157 |
| 4,982,660 | 1/1991 | Hamm et al. | 101/157 |
| 5,027,513 | 7/1991 | Allison, Jr. | 101/157 |
| 5,058,502 | 10/1991 | Köbler et al. | 101/366 |
| 5,072,669 | 12/1991 | Weisbrod et al. | 101/142 |
| 5,085,144 | 2/1992 | Lindstrom et al. | 101/363 |
| 5,125,341 | 6/1992 | Yaeso | 101/367 |
| 5,184,556 | 2/1993 | Schaeuble | 101/366 |
| 5,226,363 | 7/1993 | Weishew | 101/366 |
| 5,226,364 | 7/1993 | Fadner | 101/450.1 |
| 5,239,925 | 8/1993 | Bobo | 101/366 |
| 5,341,741 | 8/1994 | Schneider et al. | 101/365 |
| 5,440,982 | 8/1995 | Meadows et al. | 101/363 |
| 5,517,918 | 5/1996 | Van Denend | 101/366 |
| 5,560,294 | 10/1996 | Anders et al. | 101/366 |

*Primary Examiner*—Edgar Burr
*Assistant Examiner*—Daniel J. Colilla

[57] ABSTRACT

A pair of doctor blade assemblies extend from upper and lower ends of a housing. Seal assemblies having compressible seals, seal spacers and retaining plates are disposed at opposite ends of the housing and extend between the upper and lower doctor blade assemblies. The doctor blade assemblies, the seal assemblies, the inner surface of the housing and the outer surface of the transfer roll define a fully encapsulated applicator chamber. The upper blade assembly includes a doctor blade positioned as a trailing edge blade, a blade support for clamping the blade and for securing the blade to the housing, a blade seal positioned for sealing the ink chamber and a pneumatic assembly for adjusting the pressure of the trailing doctor blade against the transfer roll. The lower blade assembly includes a doctor blade positioned as a trailing edge blade and a blade support for clamping the blade and for securing the blade to the lower end of the housing. The angle of inclusion formed between the doctor blades is at least about 150 degrees. The plates, seals and spacers of the seal assemblies have arcuate front edges which follow along and abut ends of the transfer roll. An adjustable slide mechanism moves the housing, the blade assemblies and the end seal assemblies into and out of contact with the transfer roll. Pneumatic cylinders connected to the upper blade assembly apply precise wiping pressure. Knobs allow turning connecting screws for minor positioning adjustments.

26 Claims, 4 Drawing Sheets

FIG. 9
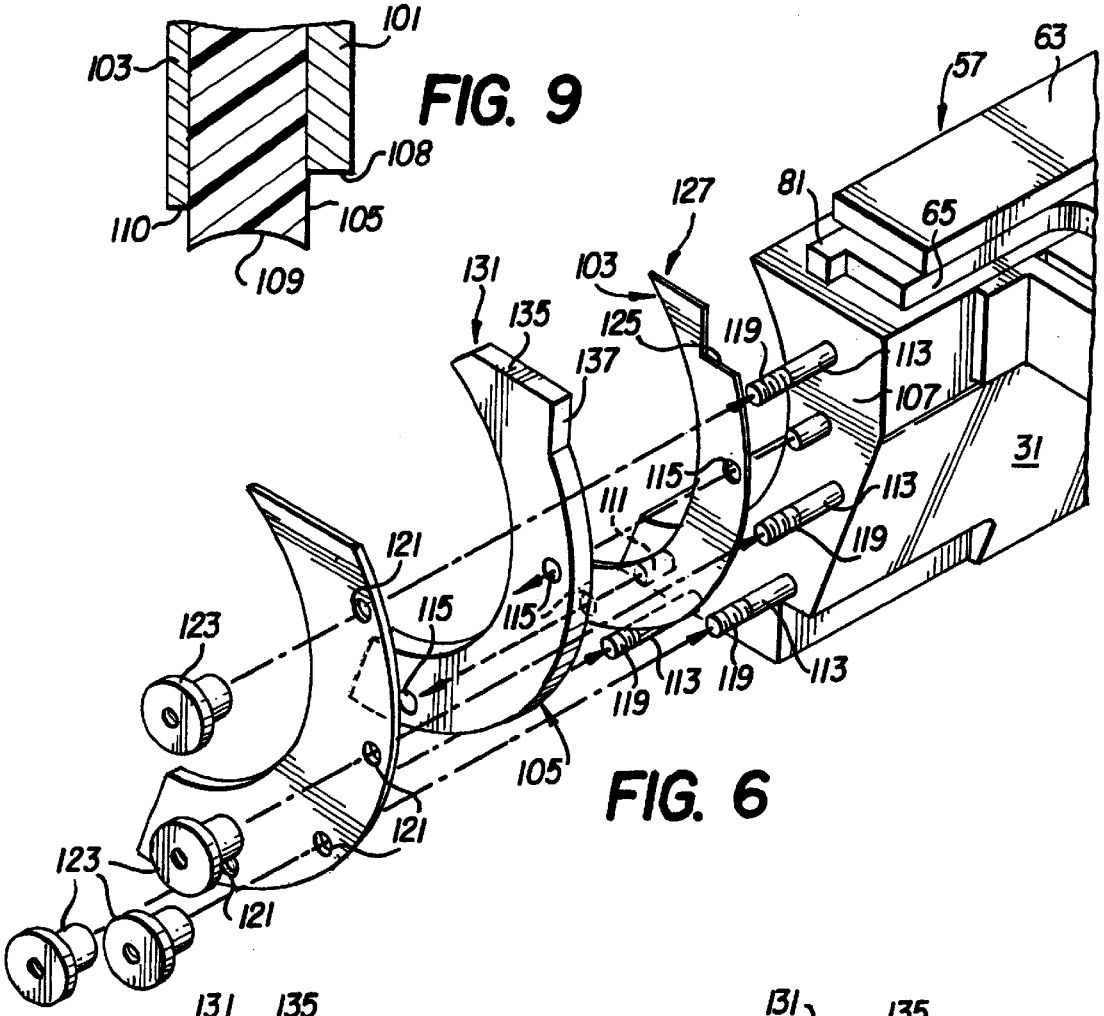
FIG. 6
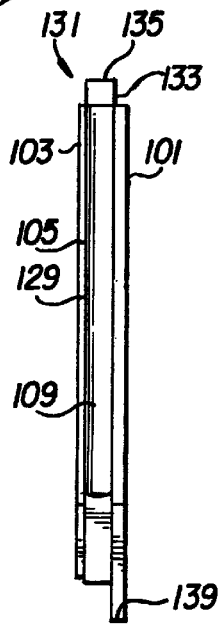
FIG. 7
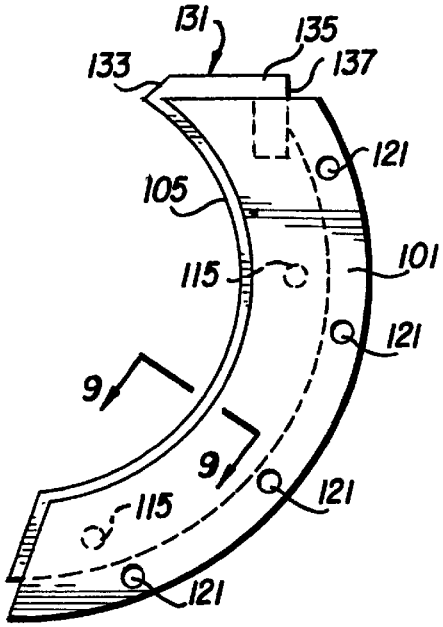
FIG. 8

GRAVURE PRINTING PRESS WITH ENCAPSULATED INK APPLICATOR AND METHOD

FIELD OF THE INVENTION

The present invention relates to a method of and an apparatus for applying fluid, such as ink, adhesive, coatings and the like, to rotating transfer rolls.

BACKGROUND OF THE INVENTION

In the manufacture of printed paper, paperboard and other printed web products, words and designs in various colors are applied to a surface of a web or sheet using a rotating transfer roll. In a conventional printing process known as the gravure process, the transfer roll is a cylinder having cells provided about its peripheral surface. The cells are small, shallow depressions engraved in the surface of the roll which retain ink or other printing fluid when passed through a fluid bath or a fluid applicator chamber. The cylinder is provided between the fluid chamber and an impression roll and is positioned for rotational contact with the impression roll. The cylinder and the impression roll rotate in opposite directions, with the web being pressed therebetween. As the cylinder rotates, printing fluid from the fluid chamber is retained in the cells of the cylinder. Prior to the press nip, a doctor blade is positioned for contacting the peripheral surface of the transfer roll. The edge of the doctor blade levels and removes excess printing fluid from the surface of the cylinder. At the nip,. printing fluid is released from the cells and transferred to the surface of the web.

In another printing process known as flexographic printing, a plate cylinder having raised rubber regions extending from its peripheral surface is provided between the transfer, or anilox, roll and an impression roll. The anilox and impression rolls rotate in the same direction, while the plate cylinder rotates in an opposite direction and contacts the peripheral surfaces of both rolls. The web is pressed between the impression roll and the plate cylinder. Cells provided on the outer surface of the rotating anilox roll retain printing fluid from the fluid chamber. A doctor blade positioned before the contact point between the anilox roll and the plate cylinder meters the fluid onto the surface of the anilox roll. The fluid is transferred from the surface of the anilox roll to the raised regions of the plate cylinder, which in turn transfers the fluid to the web at the press nip.

Doctor blade systems in existing printing press machines generally include two or more doctor blades which contact the peripheral surface of a rotating roll. At least one, and typically all the blades, are reverse angle blades, or blades positioned such that the roll surface rotates toward the doctoring edge. A typical doctor blade assembly having a reverse angle blade in combination with a trailing angle blade (i.e., blade positioned such that the roll surface rotates away from the blade) is disclosed in U.S. Pat. No. 4,945,832.

According to the apparatus disclosed in U.S. Pat. No. 4,821,672, a doctor blade assembly includes a pair of blades disposed on opposite sides of an applicator ink cavity. The blades converge as they extend toward the transfer roll. A pivot shaft and handle assembly operate to move the blades and applicator into and out of engagement with the transfer roll. Seal assemblies, including end plates resiliently bearing on the end surfaces of the transfer roll and seal members secured to the end plate and disposed to engage the endmost portion of the circumferential roll surface, are provided for preventing seepage of ink from the cavity. The enclosed wet angle defined between the upper reverse angle doctor blade and the lower trailing angle doctor blade is usually small, generally in the range of ninety degrees or less.

According to the apparatus disclosed in U.S. Pat. No. 5,239,925, an ink distribution assembly for flexographic or gravure printing presses provides for limited exposure of transfer rolls to the atmosphere. To function properly, the assembly must include three or more doctor blades defining two or more adjacent reservoirs. The doctor blade immediately following the press nip extends at a trailing angle to the transfer roll but does not contact the transfer roll. The intermediate blades and the lower reverse angle blade are in constant contact with the transfer roll surface.

According to the apparatus disclosed in U.S. Pat. No. 2,151,968, an inking mechanism for a rotogravure press includes an ink channel defined by a bottom plate, a trailing angle doctor blade and a sealing blade. The sealing blade is formed of very thin steel or of a non-metallic composition and has a curved lower end which extends along the peripheral surface of the printing cylinder. The ends of the channel are not sealed to the printing cylinder. Rather, raised bands provided along the bottom plate and ink guards provided at the ends of the printing roll function to limit discharge of ink through the ends of the ink channel. The surface of the printing roll is exposed to the atmosphere for a majority of its rotation.

It has been found that acceptable printing quality depends on uniform coating of the transfer roll. The term "transfer roll" as hereinafter used includes both anilox rolls for flexographic presses and print cylinders of gravure printing presses unless otherwise stated. Printing fluid tends to dry in the cells of the transfer roll when the surface of the transfer roll is exposed to atmospheric conditions. The dried printing fluid clogs the cells and prevents the cells from retaining adequate levels of transferrable fluid. Streaking and other undesired printing phenomena result. Cleaning or replacing the rolls with clogged cells is time consuming and costly.

It has been further found that the ink applicator cavity for printing presses must be sealed for effectively recycling the printing fluid and for reducing the escape of solvent vapors emanating from the printing fluid into the work environment. Exposing printing fluid on the print cylinder or in the applicator cavity to atmospheric conditions causes the fluid to dry or to thicken. Further, seepage of the ink from the cavity and excess ink flung from rapidly rotating rollers necessitate inconvenient and often troublesome cleanup. It has been further found that reverse angle blades of doctor blade systems cause increased wear to the transfer roll surface.

It would be desirable therefore to provide a method of and an apparatus for minimizing exposure of the print cylinder in a gravure press to atmospheric conditions to eliminate the aforementioned problem of escape of solvent vapors to the work environment.

SUMMARY OF THE INVENTION

The present invention is directed to a method of and an apparatus for minimizing exposure of the transfer roll and the fluid applicator cavity of a printing press to atmospheric conditions. As used herein, the term "fluid" includes ink, adhesive, coatings and the like. Fluid is applied to a rotating transfer roll through an applicator assembly. The assembly comprises a housing having a fluid supply inlet and multiple drains. Upper and lower doctor blade assemblies extend inwardly from the longitudinal edges of the housing. Each doctor blade assembly comprises a blade holder and a doctor blade positioned as a trailing edge blade to contact the peripheral surface of the rotating transfer roll. The upper doctor blade meters the fluid applied to the peripheral surface of the transfer roll and provides a peripheral seal to retain the fluid in the enclosed cavity. The lower doctor blade wipes paper dust and contaminants from the transfer roll and also seals the fluid in the chamber. End seal assemblies are disposed at each end of the housing and extend between the upper and lower doctor blade assemblies. Each end seal assembly includes an inner seal spacer, an intermediate end seal and an outer seal retaining plate. The encapsulated fluid applicator chamber extends longitudinally parallel to the axis of rotation of the transfer roll and is defined by the housing, end seal assemblies, upper and lower doctor blade assemblies and the peripheral surface of the rotating transfer roll. Arcuate edges of the seal assemblies sealingly engage the ends of the rotating roll and the endmost portions of the roll surface. A positioning mechanism is provided for moving the housing, the doctor blade assemblies and the seal assemblies as a unit into and out of sealing engagement with the rotating transfer roll. When properly aligned, the seal and doctor blade assemblies form a leak-tight seal for the fluid in the applicator chamber.

The integrity of the fluid applied to the rotating roll is maintained in the encapsulated fluid applicator chamber. During operation, the seal and doctor blade assemblies are in constant sealing contact with the rotating roll. Accordingly, external contaminants and atmospheric conditions which detrimentally influence the effectiveness of the fluid are eliminated from the printing process. Recycling of the fluid and workplace cleanliness and safety are also enhanced as the drains of the reservoir serve as the only exit ports for the fluid or the fumes emanating therefrom apart from the printing cells on the roll periphery.

The fluid applicator is brought into engagement with the transfer roll using an adjustable slide mechanism. The mechanism, which is connected to the applicator housing, urges the applicator toward the transfer roll until the arcuate edges of the seal assemblies rest snugly against the ends of the roll. If necessary, the seal and doctor blade assemblies are adjusted using adjustment knobs. The knobs are connected to screws extending through threaded holes provided in the seal assemblies and the upper blade holder.

Edges of the doctor blades are positioned in contact with the peripheral surface of the roll such that the roll rotates away from the doctoring edges. The angle of inclusion between the two doctor blades at the roll contact points is substantially large, generally in the range of 150 to 180 degrees. Accordingly, the peripheral surface of the transfer roll passes through the encapsulated cavity for a substantial part of roll rotation, thereby minimizing exposure of the surface of the roll to atmospheric conditions.

The wiping pressure, or pressure exerted by the doctor blades on the transfer roll, is adjusted independent of sealing pressure. A pneumatically-driven member has a first end connected to the upper blade support and a second end connected to one or more pneumatic cylinders. The member, when driven by the cylinders, moves the blade support, thereby adjusting the force exerted by the doctor blade on the roll. The applicator sealing pressure is not affected by movement of the blade assembly.

Fluid is introduced to the longitudinal applicator chamber via a supply inlet provided in the housing. As the transfer roll rotates, printing fluid is retained in engraved cells provided about the peripheral surface of the roll. The upper trailing angle doctor blade contacts the peripheral surface of the roll as it rotates, removing excess fluid from the surface. Fluid flung from the rapidly rotating roll strikes inner surfaces of the applicator defining the chamber and is recirculated to the exit drains of the chamber along with unused fluid. The metered surface of the roll passes through the press nip, where the printing fluid is transferred from the transfer roll either directly to a web travelling between the transfer roll and an impression roll or to flexible raised regions of a plate cylinder. The surface of the transfer roll, now carrying paper dust and contaminants from the web and substantially no printing fluid, rotates past the lower trailing angle doctor blade, which wipes the peripheral surface of the roll and prepares that surface to receive a fresh application of fluid.

With the foregoing and other advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 6 is an exploded perspective view of the seal assembly of the fluid applicator apparatus;

FIG. 7 is a front elevation view of a constructed seal assembly;

FIG. 8 is a left side elevation view of the seal assembly shown in FIG. 7; and FIG. 9 is a fragmentary cross-section taken along line 8—8 of FIG. 8.

DETAILED DESCRIPTION OF THE INVENTION

Figure 1:
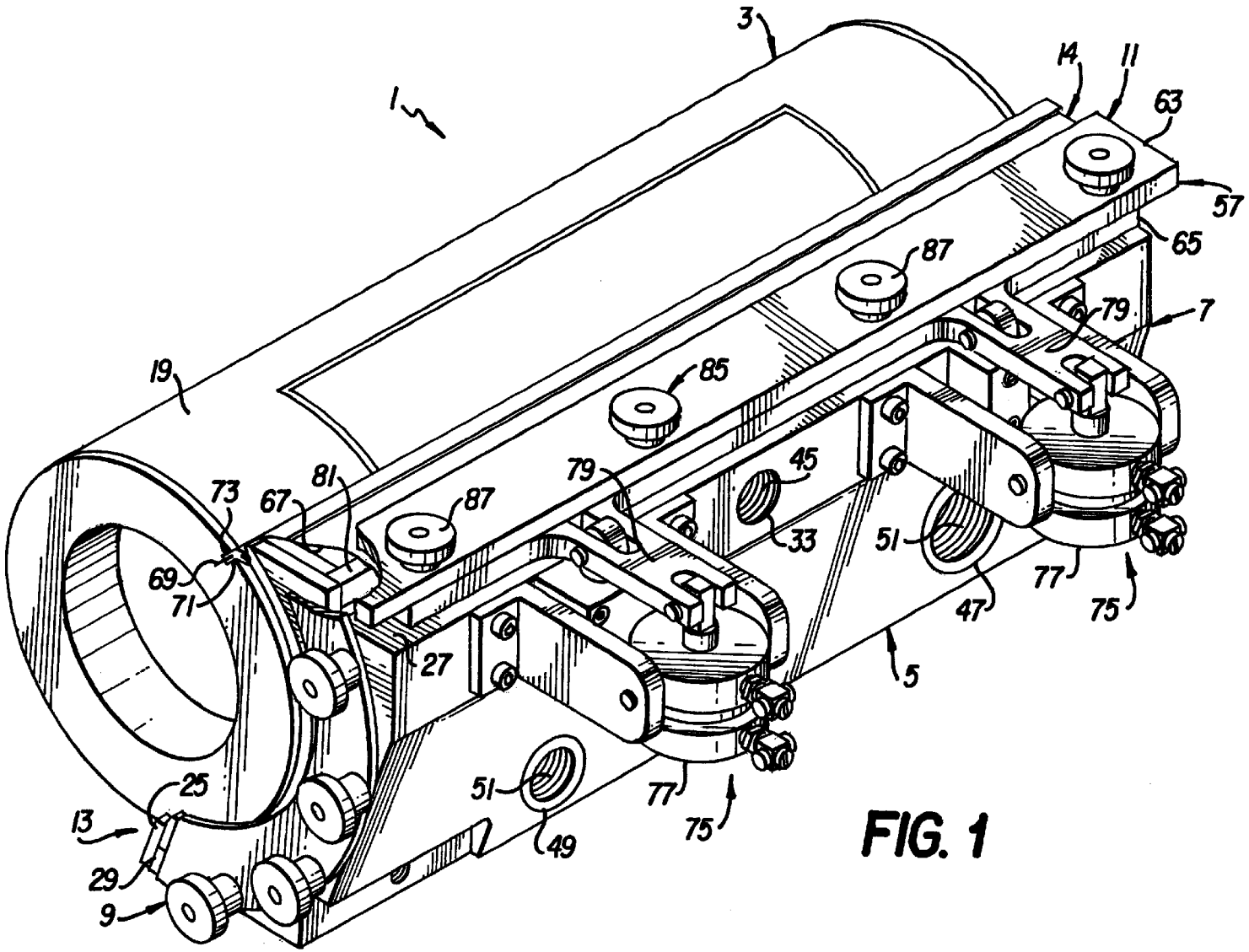
FIG. 1 is a perspective view of the fluid applicator apparatus of the invention.

Referring now to the drawings, FIG. 1 illustrates a preferred embodiment of the encapsulated fluid applicator of the invention, generally designated by the reference numeral 1, for applying fluid, such as ink, adhesive, coatings and the like, to the circumferential surface of a transfer roll 3 having a longitudinal axis. In the following discussion, and in the figures referenced therein, the preferred embodiment of the present invention is described with respect to an engraved print cylinder that is typically used in a gravure printing process. It should be understood, however, that the present invention is compatible for use in flexographic presses. Therefore, the term "transfer roll" as used hereinafter may designate either the print cylinder of a gravure system or the anilox roll of a flexographic system.

Referring to FIGS. 1–5, the applicator 1 includes an elongated housing 5, end seal assemblies 7, 9, an upper doctor blade assembly 11 and a lower doctor blade assembly 13. Each doctor blade assembly 11 or 13 supports a trailing edge doctor blade 14 or 15, respectively. The doctor blade assemblies contact the surface of the roll at trailing angles. As noted above in the background of the invention, this means that the blades are positioned such that the roll surface rotates away from the blade. An fluid chamber 17 is defined by the arcuate front surface of the housing 5, the seal assemblies 7, 9, the doctor blade assemblies 1, 13, and a portion of the peripheral surface 19 of the roll 3. When the applicator 1 is moved into engagement with a transfer roll 3 that is rotatably mounted on a support, the trailing edge doctor blades 14, 15 contact the peripheral surface 19 of the transfer roll 3 and arcuate edges 21 of the seal assemblies 7, 9 sealingly engage the peripheral surface 19 of the transfer roll 3. The applicator chamber 17 is thereby closed by the peripheral surface 19 of the transfer roll 3, creating an encapsulated fluid chamber substantially free from exposure to atmospheric conditions. With an angle of inclusion between the trailing edge doctor blades 14, 15 of about 150–180 degrees, the surface 19 of the transfer roll 3 remains in the encapsulated chamber 17 for a substantial part of each rotation, thereby limiting atmospheric exposure and reducing the occurrence of fluid drying in the cells of the surface 19 of the transfer roll 3.

Figure 2:
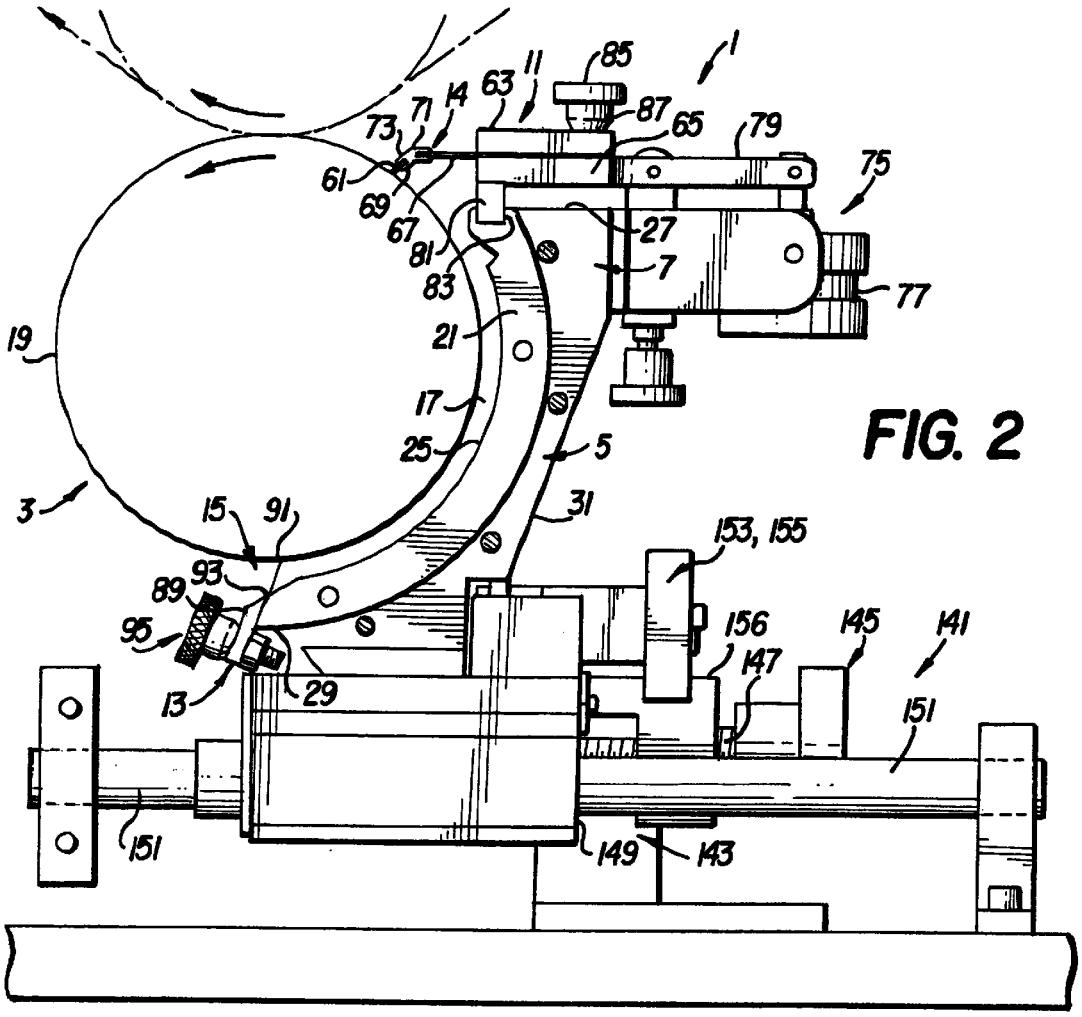
FIG. 2 is a side elevation view of the fluid applicator apparatus.

Elongated housing 5 has an arcuate front surface 25. The upper doctor blade assembly 11 is connected to and extends along an upper longitudinal surface 27 of the housing 5. A lower doctor blade assembly 13 is connected to and extends along a lower longitudinal surface 29 of the housing 5 (FIG. 2). Both doctor blade assemblies 11, 13 extend substantially the entire length of the housing 5. Sealing assemblies 7, 9 are connected to and partially form the sides of the housing 5.

Figure 4:
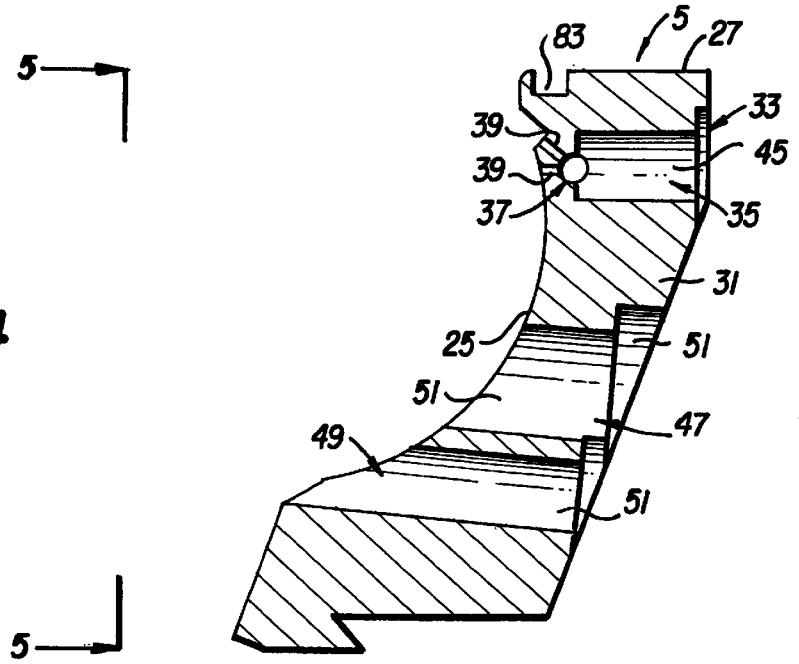
FIG. 4 is a cross-sectional view of the housing of the fluid applicator apparatus taken along line 4—4 of FIG. 3.
Figure 5:
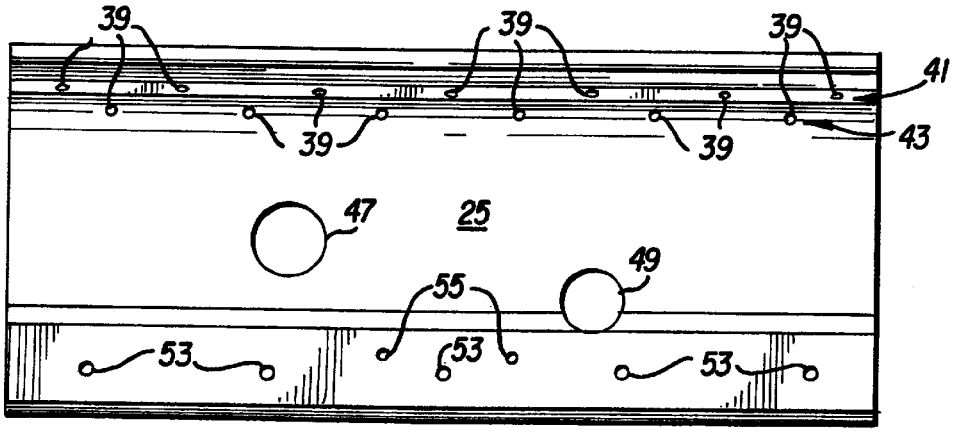
FIG. 5 is a front elevation view of the housing of the fluid applicator apparatus with the doctor blade and seal assemblies removed.

The housing 5 of the present applicator 1 includes a front surface 25 and a rear surface 31. The front surface 25 is arcuate and forms one side of the fluid chamber 17. The housing further includes a fluid supply inlet 33 that extends laterally through the housing 5 from the rear surface 31 to the front surface 25 for supplying fluid to the chamber 17. As shown in FIG. 4, the supply inlet 33 includes a passageway 35 and a distribution assembly 37, such as a manifold, positioned between the passageway 35 and the front surface 25 of the housing 5 for evenly distributing fluid over the length of the transfer roll 3. As shown in FIG. 5, the front surface 25 of the housing 5 has two rows of multiple, staggered exit ports 39 provided therein through which fluid enters the chamber 17 from the distribution assembly 37. The upper row 41 of exit ports 39 releases a fluid flow that is oriented slightly upward; the lower row 43 of exit ports 39 releases a fluid flow that is oriented slightly downward (FIG. 4). The number of exit ports 39, and their arrangement, orientation and position, may be varied, with such variations being considered within the scope of the present invention. The surface of the passageway 35 in the rear surface 31 of the housing 5 is threaded as at 45 for receiving and securely holding a threaded end of a fluid inlet line (not shown) extending between the housing 5 and a fluid pumping system (not shown).

Unused fluid is removed from the fluid chamber 17 for recycling through a high level drain 47 and a low level drain 49. The drains 47, 49 extend completely through the housing 5, with portions of their inner surfaces near the back surface 31 of the housing 5 having threads 51 provided thereon for receiving and securely holding a threaded end of a fluid outlet line. As shown in FIGS. 1 and 4, the supply inlet 33 is centrally located near the upper surface 27 of the housing 5, with the drains 47, 49 positioned beneath and on opposite sides of the inlet 33. It should be readily apparent that the number of drains 47, 49 and/or inlets 33, along with the positioning of those elements, may be varied, with such variations considered to be within the scope of the present invention.

Referring again to FIG. 5, the housing 5 includes a lower longitudinal row of threaded bores 53. Each threaded bore 53 receives a connector, such as a screw, for mounting the lower blade assembly 13 to the housing 5. Additional threaded bores 55 are provided through which connectors for joining a slide mechanism or carriage extend. Sealing means are preferably used with the connectors extending through the bores 53, 55 for preventing fluid from leaking through the bores 53, 55 and for blocking air flow into the chamber 17.

Figure 3:
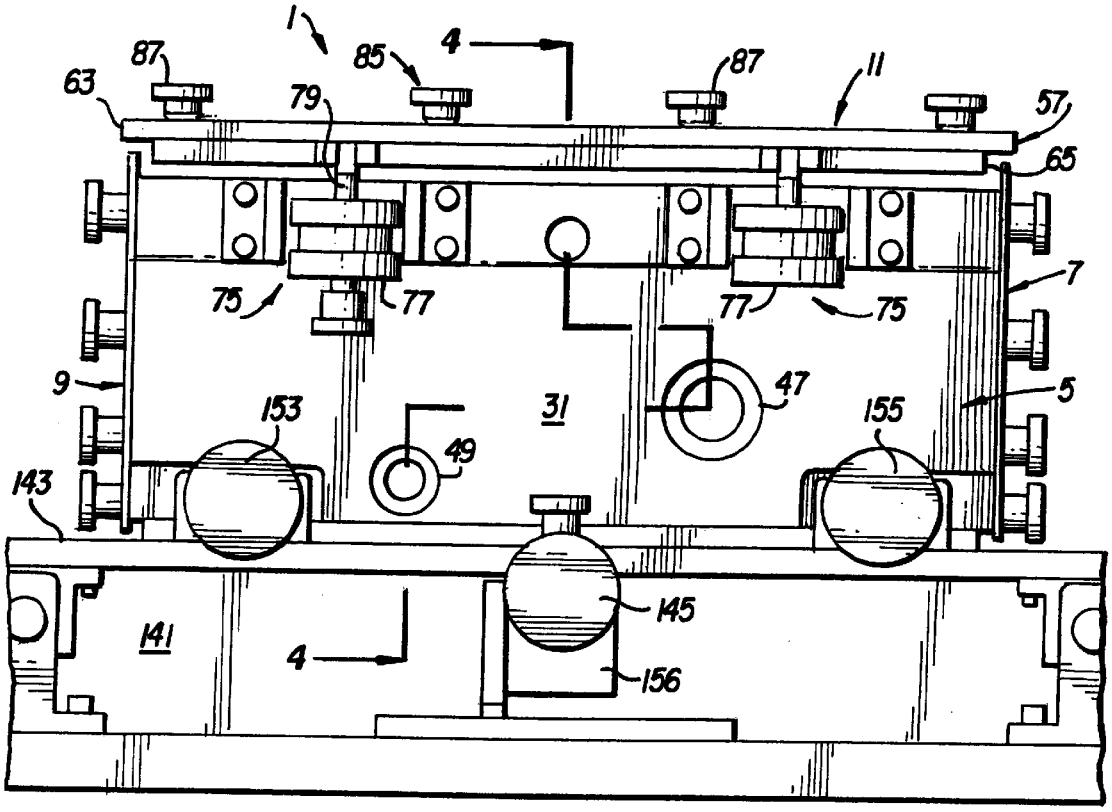
FIG. 3 is a rear elevation view of the fluid applicator apparatus.

Referring to FIGS. 1, 2 and 3, the upper blade assembly 11 extends along the upper surface 27 of the housing 5. The assembly 11 includes a blade support 57 that is connected to the housing 5 and a doctor blade 14 having an outer doctoring edge 61 positioned for contact with the transfer roll 3 at a trailing angle. The blade support 57 preferably includes an upper clamping block 63 and a lower clamping block 65, with a portion of the blade 14 being tightly clamped therebetween. The doctor blade 14 extends outward from between the blocks 63, 65 such that the outer edge 61 of the blade 14 bears against the peripheral surface 19 of the transfer roll 3 substantially along the entire length of the roll 3. The blade 14 is made of metal, hard plastic, or any other acceptable material, and preferably includes a first, generally flat, planar portion 67 extending from the blade support 57, a generally flat, straight doctoring portion 69 and a curved or angled elbow 71 connecting the first portion 67 to the doctoring portion 69. The elbow 71 has an outer part 73 that supports the doctoring portion 69 of the blade 14 and allows the outermost edge 61 of the doctoring portion 69 to contact the transfer roll 3 at a desired angle. Such a blade is known as an angle blade and may be purchased from the Angle Blade Company in Plattsborough, N.Y. Other types of doctor blades may be used.

The upper blade assembly 11 further includes an adjusting means 75 for positioning the outer edge 61 of the doctor blade 14 in contact with the peripheral surface 19 of the transfer roll 3 at a uniform pressure independent of sealing pressure. The adjusting means 75 is preferably an automatic apparatus that includes at least one pneumatic cylinder 77 connected to the lower clamping block 65 by an arm 79. In a preferred embodiment, a blade to roll pressure of between about 3–4.5 pounds per linear inch (pli) is used. It should be understood, however, that the adjusting means 75 may be any manual or automatic positioning means.

Referring to FIG. 2, a longitudinal doctor blade seal 81 extends beneath the upper doctor blade support 57. The seal 81, which is made of elastomeric material, plastic, or other acceptable sealing material, extends the length of the housing 5 and is pressed between the doctor blade support 57 and the housing 5 to seal the ink chamber 17 between the housing 5 and the upper doctor blade assembly 11. Referring to FIG. 4, a cutout region 83, corresponding in size and shape to the cross-section and dimensions of the seal 81, is provided along the upper surface 27 of the housing 5 for receiving the seal 81. The opposite ends of the seal 81 sealingly abut the walls of the sealing assemblies 7, 9.

Adjustable fastening means 85 are provided along the upper doctor blade support 57 for releasably engaging the first portion 67 of the doctor blade 14. The fastening means 85 preferably includes screws or the like extending through threaded holes provided along the length of the upper clamping block 63. Knurled knobs 87 are provided on outer ends of the screws for facilitating manual adjustment.

Referring to FIGS. 1 and 2, the lower doctor blade assembly 13 extends along the lower end 29 of the housing 5. The assembly 13 includes a blade support 89 that is connected to the housing 5 and a doctor blade 15 having an outer doctoring edge 91 positioned for contact with the peripheral surface 19 of the transfer roll 3 at a trailing angle. The blade support 89 preferably includes a clamping block 93, with a portion of the blade 15 being tightly clamped thereby. The doctor blade 15 extends outward from the blade support 89 such that the outer edge 91 of the blade 15 bears against the peripheral surface 19 of the transfer roll 3 substantially along the entire length of the roll 3. The blade 15 is made of metal, hard plastic, or any other acceptable material and is preferably a generally flat, planar blade structure. As shown in FIG. 2, the lower doctor blade 15 seals the lower front end of the fluid chamber 17 and wipes contaminants and paper dust from the peripheral surface 19 of the transfer roll 3 prior to its rotation through the fluid chamber 17. Securing screws 95 extending through the blade support 89 are provided to clamp blade 15 in place so that the outer edge 91 is against the peripheral surface 19 of the transfer roll 3.

Referring to FIG. 2, the fluid chamber 17, defined along its top and bottom ends by the upper doctor blade 14 and the lower doctor blade 15, respectively, covers a substantially large arcuate portion of the peripheral surface 19 of the transfer roll 3. The angle of inclusion established by the doctor blades 14, 15 is preferably at least 150–180 degrees. Both doctor blades 14, 15 have trailing edges (i.e., blade positioned such that the roll surface rotates away from the outer doctoring edge of the blade) which contact the surface 19 of the transfer roll 3, with the upper doctor blade 14 metering fluid collected along the peripheral surface 19 of the roll 3 and the lower doctor blade 15 wiping paper dust and other contaminants from the roll surface 19 to prevent such undesired impurities from polluting the fluid chamber 17. The doctor blades 14, 15 also seal the fluid chamber 17 from atmospheric conditions and prevent seepage of the fluid from the chamber 17.

Referring to FIGS. 1 and 6–8, the applicator 1 further includes seal assemblies 7, 9 for sealing the ends of the fluid chamber 17 and for sealingly engaging the surface of the transfer roll 3. The seal assemblies 7, 9 further allow for static fluid pressure above atmospheric pressure to be maintained within the fluid chamber 17. Each seal assembly 7, 9 includes an outer end plate 101, an inner seal spacer 103 and an end seal 105 sandwiched between the end plate 101 and the seal spacer 103. All three parts 101, 103, 105 are connected to a side surface 107 of the housing 5, with the seal spacer 103 separating the seal 105 from the housing 5. End seal 105 has a continuous, arcuate front surface 109 that bears directly against the peripheral surface 19 of the roller 3, as shown in FIG. 1.

To effect a satisfactory seal, the constituent parts of the seal assemblies 7, 9 are connected in a staggered relationship, as shown in FIG. 8. The end seal 105 and the seal spacer 103 are positioned slightly forward of the end plate 101. Referring to FIG. 9, the front surface of the end seal 105 extends beyond the front edge 110 of the seal spacer 103. When brought into engagement with the transfer roll 3, only the front surface 109 of the seal 105 directly impinges the fluid-carrying peripheral surface 19 of the roll 3. The front surface 108 of the end plate 101 bears against the surface of the roll 3.

Referring to FIG. 6, each seal assembly 7, 9 is mounted to a side 107 of the housing 5. Locating pins 111 are provided along the side 107 of the housing 5 near the front edge thereof and threaded studs 113 extend from the side 107 of the housing 5 closer a rear edge thereof. The pins 111 and the studs 113 are positioned such that the constituent parts (101, 103, 105) of the respective seal assembly 7 or 9 are mounted in a staggered arrangement as provided above. The pins 111 extend through holes 115 provided through the seal spacer 103 and the end seal 105, with outer ends of the pins 111 terminating prior to or abutting the inner surface of the end plate 101 when the seal assembly 7 or 9 is constructed. The studs 113 have threaded outer ends 119 and extend through transverse holes 121 provided near the back edge of the end plate 101. Knurled knobs 123 are provided on the threaded ends 121 of the studs 113 for adjusting the force with which the seal spacer 103 and the end seal 105 are pressed against the side 107 of the housing 5.

The seal spacer 103 of each seal assembly 7, 9 has a notch 125 provided along its upper edge 127. When connected to the housing 5, a corresponding end of the doctor blade seal 81 extending beneath the upper doctor blade assembly 11 passes through the notch 125 and abuts the inner surface 129 of the end seal 105.

The end seal 105 is preferably made of a resilient, durable elastomer or plastic and has a thickness that is substantially greater than that of the seal spacer 101, as shown in FIGS. 7 and 9. The end seal 105 has dimensions and a shape for effectively sealing sides of the fluid chamber 17 and for preventing seepage of fluid therefrom. In one embodiment, as best shown in FIG. 8, the end seal 105 has an upper end 131 that follows the dimensions of the upper doctor blade 14. The upper end 131 has a first part 133 sloping upward from the front surface 109, a second part 135 extending generally horizontally from the first part 133, and a third part 137 extending generally vertically from the second part 135 and meeting the arcuate rear surface of the end seal 105. The first part 133 and the second part 135 of the upper edge 131 of the end seal 105 extend above the upper edges of the seal spacer 103 and the end plate 101, as shown in FIGS. 7 and 8. When assembled the upper end 131 of each end seal 105 bears against the lower surface of the upper doctor blade 14 and seals the upper portion of the chamber 17. FIG. 7 further shows the lower end 139 of the end plate 101 extending beyond the lower edge of the end seal 105 and the seal spacer 103 for sealing the lower end of the chamber 17.

Alternative embodiments of the present invention incorporating seal assemblies 7, 9 having various shapes, sizes and dimensions are possible, with such embodiments being considered to be within the scope of the present invention.

Referring to FIGS. 2 and 3, a slide mechanism 141 is provided for moving the applicator 1 into and out of sealing engagement with the transfer roll 3. The slide mechanism 141 includes a movable carriage 143 connected to the applicator housing 5. An automatic or manual driving system is provided for moving the carriage 143 perpendicular (up and down or parallel (in and out) to the axis of the transfer roll, or both. In one embodiment, the driving system of the slide mechanism 141 includes at least one hydraulic or pneumatic cylinder 156 connected to the carriage assembly 143 by a plate. The carriage 143 has bushings 149 through which rails 151 extend. The pressure cylinder 156 urges the carriage 143 along the rails 151, in turn moving the applicator 1 into or out of engagement with the transfer roll 3. Knob 145 is connected to the housing 147 for positioning the applicator 1 such that a desired sealing pressure is established and maintained. Additionally, knobs 153 and 155 lock applicator 1 to carriage 143 and are threadably received in bores provided in the housing 5 near opposite lower corners thereof. Importantly, the slide mechanism 141 provides for the establishment of a sealing pressure independent of the doctor blade pressure.

The present invention operates as follows. The printing fluid applicator 1 is brought into contact with a rotatable roll 3 using a slide mechanism 141 or similar positioning system. When properly aligned, front surfaces 109 of end seals 105 of the applicator 1 sealingly engage the transfer surface 19 of the roll 3, with the end plate 101 of each assembly 7, 9 bearing against the roll 3. The trailing edge doctor blade 14 of the upper doctor blade assembly 11 extends the length of the peripheral surface 19 of the roll 3 and contacts the surface 19 at a pre-nip location. Similarly, the trailing edge doctor blade 15 of the lower doctor blade assembly 13 extends the length of the peripheral surface 19 of the transfer roll 3 and contacts the rotatable roll 3 at a post-nip location. The positions of the doctor blades 14 and 15 may be manually adjusted. The wiping pressure of the upper doctor blade 14 is adjusted to a desired pressure, preferably using a pneumatically controlled system. Preferably, the wiping pressure at the pre-nip location is maintained in the range of about 3–4.5 pli. Sealing pressure is adjusted independent of the wiping pressure to provide for an encapsulated applicator chamber 17 between the fluid applicator housing 1 and the rotatable roll 3. Preferably, the sealing pressure is maintained in a range of about one atmosphere. When the desired wiping and sealing pressures are established, fluid is delivered to the applicator chamber 17. The rotating roll 3 collects fluid along its peripheral surface 19 as it rotates through the chamber 17. At the pre-nip location, the peripheral surface 19 of the roll 3 is metered by the upper doctor blade 14. The metered surface then exits the chamber 17 and eventually contacts a web or another roll and transfers the fluid thereto. Subsequent to fluid transfer, the roll 3 rotates towards the post-nip location, where the trailing edge doctor blade 15 of the applicator 1 wipes contaminants and paper dust from the peripheral surface 19 of the roll 3.

From the foregoing, it will be appreciated by those skilled in the art that the present invention provides a particularly effective and advantageous process and apparatus for solving several problems associated with the manufacture of printed webs.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. Apparatus for distributing fluid on a surface of a rotating transfer roll comprising:

a housing having a fluid supply inlet and an inner surface;

an upper doctor blade assembly extending from an upper side of said housing, said upper doctor blade assembly having an upper blade support connected to said housing and an upper doctor blade positioned for contact with said surface of said transfer roll at a trailing angle at a first location;

a lower doctor blade assembly extending from a lower side of said housing, said lower doctor blade assembly having a lower blade support connected to said housing and a lower doctor blade positioned for contact with said surface of said transfer roll at a trailing angle at a second location; and end seal assemblies disposed at opposite ends of said housing and extending between said upper and lower doctor blade assemblies, said inner surface of said housing, said upper doctor blade, said lower doctor blade and said end seal assemblies defining only one fluid application chamber;

wherein said upper doctor blade and said lower doctor blade contact said transfer roll such that the first location and the second location are spaced around a circumference of the transfer roll to define two angles, the smaller of which is at least about 150 degrees.

2. Apparatus according to claim 1, including means for moving said housing toward and away from said transfer roll and means independent of said moving means and connected to said upper doctor blade assembly for urging said upper doctor blade into operative contact with said transfer roll.

3. Apparatus of claim 1, including a doctor blade seal extending beneath said upper blade support and extending from at least an inner surface of said housing outward for sealing said fluid applicator chamber.

4. Apparatus according to claim 1, wherein said upper doctor blade has a generally flat portion and an outer doctoring end extending at an angle from said flat portion.

5. Apparatus according to claim 1, wherein said housing has at least one drain.

6. Apparatus according to claim 1, wherein said upper blade assembly has a doctor blade seal positioned beneath said blade support for preventing fluid from exiting said fluid application chamber, and adjustable fastening means for releasably securing said upper doctor blade.

7. Apparatus according to claim 6, wherein said adjusting means has screws passing through threaded bores provided in said blade support, and rotatable knobs provided on outer ends of said screws for adjusting a position of said upper doctor blade.

8. Apparatus according to claim 1, wherein said fluid is selected from the group consisting of ink, adhesive and coating.

9. Apparatus for distributing fluid on a surface of a rotating transfer roll comprising:

a housing having a fluid supply inlet and an inner surface;

an upper doctor blade assembly extending from an upper side of said housing, said upper doctor blade assembly having an upper blade support connected to said housing and an upper doctor blade positioned for contact with said surface of said transfer roll at a trailing angle;

a lower doctor blade assembly extending from a lower side of said housing, said lower doctor blade assembly having a lower blade support connected to said housing and a lower doctor blade positioned for contact with said surface of said transfer roll at a trailing angle;

end seal assemblies disposed at opposite ends of said housing and extending between said upper and lower doctor blade assemblies, said inner surface of said housing, said upper doctor blade, said lower doctor blade and said end seal assemblies defining only one fluid application chamber;

moving means for moving said housing toward and away from said transfer roll; and urging means independent of said moving means and connected to said upper doctor blade assembly for urging said upper doctor blade into operative contact with said transfer roll;

wherein said urging means comprises at least one pneumatic cylinder connected to said upper blade assembly for urging said upper doctor blade into and out of contact with said surface of said transfer roll.

10. Apparatus for distributing fluid on a surface of a rotating transfer roll comprising:

a housing having a fluid supply inlet and an inner surface;

an upper doctor blade assembly extending from an upper side of said housing, said upper doctor blade assembly having an upper blade support connected to said housing and an upper doctor blade positioned for contact with said surface of said transfer roll at a trailing angle;

a lower doctor blade assembly extending from a lower side of said housing, said lower doctor blade assembly having a lower blade support connected to said housing and a lower doctor blade positioned for contact with said surface of said transfer roll at a trailing angle; and end seal assemblies disposed at opposite ends of said housing and extending between said upper and lower doctor blade assemblies, said inner surface of said housing, said upper doctor blade, said lower doctor blade and said end seal assemblies defining only one fluid application chamber;

wherein said transfer roll has a sealing surface provided at ends thereof, and wherein each end seal assembly comprises an inner seal spacer, an outer end seal retaining plate, and an end seal positioned between said seal spacer and said end seal retaining plate, said seal having a front arcuate surface for sealingly engaging said sealing surface of said transfer roll, and means for compressing said seal between said inner seal spacer and said outer seal retaining plate.

11. Apparatus according to claim 10, further comprising:

locating pins and threaded studs extending outward from each side of the housing, wherein each seal spacer and each end seal have holes provided therein through which said locating pins pass, wherein each end plate has holes provided therein through which said threaded studs pass; and adjusting means, comprising rotatable knobs provided on outer ends of said threaded studs, for adjusting a pressure with which said seal is pressed between said seal spacer and said end plate and against said side of said housing.

12. Apparatus according the claim 11, wherein said inner seal spacer, said end seal and said end seal retaining plate each have an arcuate front surface, an arcuate rear surface and a generally straight lower surface, wherein said end seal retaining plate has a generally flat upper surface, with said holes extending laterally through said plate along an edge of said surface, said seal spacer having an upper surface with a first portion extending generally horizontally from said front surface, a second portion extending generally vertically from said first portion, and a third portion extending generally vertically from a bottom edge of said second portion and joining said arcuate rear surface of said seal spacer, wherein said end seal has an upper surface with a first part sloping upward from said front surface, a second part extending generally horizontally from said first part, and a third part extending generally from said second part and meeting said arcuate rear surface, wherein said arcuate front surfaces of said end seal and said seal spacer are positioned forward of said arcuate front surface of said end seal retaining plate, wherein said arcuate front surface of said end seal is positioned forward of said arcuate front surface of said seal spacer, and wherein said upper surface of said end seal has dimensions for sealingly engaging said upper doctor blade.

13. Apparatus for distributing fluid on a surface of a rotating transfer roll comprising:

a housing having a fluid supply inlet and an inner surface;

an upper doctor blade assembly extending from an upper side of said housing, said upper doctor blade assembly having an upper blade support connected to said housing and an upper doctor blade positioned for contact with said surface of said transfer roll at a trailing angle;

a lower doctor blade assembly extending from a lower side of said housing, said lower doctor blade assembly having a lower blade support connected to said housing and a lower doctor blade positioned for contact with said surface of said transfer roll at a trailing angle;

end seal assemblies disposed at opposite ends of said housing and extending between said upper and lower doctor blade assemblies, said inner surfaces of said housing, said upper doctor blade, said lower doctor blade and said end seal assemblies defining only one fluid application chamber;

moving means for moving said housing toward and away from said transfer roll; and urging means independent of said moving means and connected to said upper doctor blade assembly for urging said upper doctor blade into operative contact with said transfer roll;

wherein said moving means comprises a carriage connected to said housing, slide rods, and a fluid cylinder for moving said carriage on said rods.

14. Apparatus for distributing fluid on a surface of a rotating transfer roll comprising:

a housing having a fluid supply inlet and an inner surface;

an upper doctor blade assembly extending from an upper side of said housing, said upper doctor blade assembly having an upper blade support connected to said housing and an upper doctor blade positioned for contact with said surface of said transfer roll at a trailing angle;

a lower doctor blade assembly extending from a lower side of said housing, said lower doctor blade assembly having a lower blade support connected to said housing and a lower doctor blade positioned for contact with said surface of said transfer roll at a trailing angle; and end seal assemblies disposed at opposite ends of said housing and extending between said upper and lower doctor blade assemblies, said inner surface of said housing, said upper doctor blade, said lower doctor blade and said end seal assemblies defining only one fluid application chamber;

wherein said housing has a generally arcuate front surface, and wherein said seal assemblies further include sealing plates, end seals and seal spacers having arcuate front surfaces.

15. Apparatus for distributing fluid on a surface of a transfer roll comprising:

a housing having a fluid supply inlet and an inner surface;

an upper doctor blade assembly extending from an upper side of said housing, said upper doctor blade assembly having an upper blade support connected to said housing and an upper doctor blade positioned for contact with said surface of said transfer roll at a trailing angle at a first location;

a lower doctor blade assembly extending from a lower side of said housing, said lower doctor blade assembly having a lower blade support connected to said housing and a lower doctor blade positioned for contact with said surface of said transfer roll at a trailing angle at a second location, said upper and said lower doctor blades oriented for contacting said transfer roll such that said first location and said second location are spaced around a circumference of said transfer roll to define two angles, the smaller of which at least about 150 degrees; and end seal assemblies disposed at opposite ends of said housing and extending between said upper and lower doctor blade assemblies, said inner surface of said housing, said upper doctor blade, said lower doctor blade and said end seal assemblies defining an applicator chamber.

16. Apparatus according to claim 15, including an urging means for urging said upper doctor blade against said transfer roll and a sealing pressure adjusting means for establishing a seal pressure in said chamber, and wherein said urging means operates independent of said sealing pressure adjusting means.

17. Apparatus for distributing fluid on a surface of a transfer roll comprising:

a housing having a fluid supply inlet and an inner surface;

an upper doctor blade assembly extending from an upper side of said housing, said upper doctor blade assembly having an upper blade support connected to said housing and an upper doctor blade positioned for contact with said surface of said transfer roll at a trailing angle at a first location;

a lower doctor blade assembly extending from a lower side of said housing, said lower doctor blade assembly having a lower blade support connected to said housing and a lower doctor blade positioned for contact with said surface of said transfer roll at a trailing angle at a second location, said upper and said lower doctor blades oriented for contacting said transfer roll such that said first location and said second location are spaced around a circumference of said transfer roll by at least about 150 degrees;

end seal assemblies disposed at opposite ends of said housing and extending between said upper and lower doctor blade assemblies, said inner surface of said housing, said upper doctor blade, said lower doctor blade and said end seal assemblies defining an applicator chamber;

an urging means for urging said upper doctor blade against said transfer roll; and a sealing pressure adjusting means for establishing a seal pressure in said chamber;

wherein said urging means operates independent of said sealing pressure adjusting means; and wherein the urging means comprises a pivot arm having a first end connected to said upper blade support and a second end, and at least one fluid cylinder connected to said second end of said upper blade support for moving said upper doctor blade into operative contact with said transfer roll.

18. Apparatus according to claim 17, wherein said upper doctor blade assembly has a doctor blade seal extending beneath said upper blade support and extending from at least an inner surface of said housing outward for sealing said fluid applicator chamber, wherein said end seal assemblies each have an inner seal spacer, an outer seal retaining plate and a compressible seal positioned between said spacer and said plate, with each of said end seals having an outer arcuate edge having dimensions for following along an outer sealing surface of said transfer roll, means for compressing said doctor blade seal between said upper blade support and said housing, and means for compressing said end seal between said inner seal spacer and said end seal retaining plate.

19. Apparatus of claim 18, said compressing means for said end seals comprising threaded studs projecting from ends of said housing and extending only through said plates of said seal assemblies and turning knobs provided on outer ends of said threaded studs, and said compressing means for said doctor blade seal comprising threaded studs projecting from said upper side of said housing and passing through threaded holes extending through at least said upper blade support, and turning knobs provided on outer ends of said threaded studs.

20. Apparatus of claim 17, wherein said sealing pressure adjusting means comprises a carriage connected to said housing and having bores therethrough, slide rods extendable through said bores of said carriage, and at least one fluid cylinder connected to said carriage by a pivot arm for moving said carriage along said rods.

21. A method of applying fluid to a surface of a rotating roll comprising the steps of:

positioning a fluid applicator in contact with a rotatable roll such that edges of end seal assemblies of said applicator abut and extend along ends of said rotatable roll;

contacting said rotatable roll at a first location with a first, longitudinally extending trailing edge doctor blade;

contacting said rotatable roll at a second location with a second, longitudinally extending trailing edge doctor blade such that said first location and said second location are spaced from each other around a circumference of said rotatable roll to define two angles, the smaller of which is at least about 150 degrees;

adjusting a sealing pressure to provide for an encapsulated applicator chamber between said fluid applicator and said rotatable roll;

adjusting a wiping pressure of said first trailing edge doctor blade;

delivering fluid to said applicator chamber defined between said fluid applicator and said transfer roll;

transferring said printing fluid from said chamber to a peripheral surface of said roll;

metering said printing fluid on said peripheral surface of said roll at said first location; and wiping contaminants and paper dust from said peripheral surface of said roll at said second location.

22. The method of claim 21, wherein said step of adjusting said sealing pressure comprises making an adjustment which is separate from said step of adjusting said wiping pressure.

23. The method of claim 21, wherein said step of adjusting said wiping pressure comprises a step of maintaining said wiping pressure at said first location in a range of about 3–4.5 pli.

24. The method of claim 21, wherein said step of adjusting said sealing pressure comprises a step of maintaining said sealing pressure in a range of about one atmosphere.

25. A method of applying fluid to a surface of a rotating roll comprising the steps of:

positioning a fluid applicator in contact with a rotatable roll such that edges of end seal assemblies of said applicator abut and extend along ends of said rotatable roll;

contacting said rotatable roll at a first location with a first, longitudinally extending trailing edge doctor blade;

contacting said rotatable roll at a second location with a second, longitudinally extending trailing edge doctor blade;

adjusting a sealing pressure to provide for an encapsulated applicator chamber between said fluid applicator and said rotatable roll;

adjusting a wiping pressure of said first trailing edge doctor blade;

delivering fluid to said applicator chamber defined between said fluid applicator and said transfer roll;

transferring said printing fluid from said chamber to a peripheral surface of said roll;

metering said printing fluid on said peripheral surface of said roll at said first location; and wiping contaminants and paper dust from said peripheral surface of said roll at said second location;

wherein said step of adjusting said wiping pressure includes pneumatically controlling a blade support clamping said first doctor blade.

26. A method of applying fluid to a surface of a rotating roll comprising the steps of:

positioning a fluid applicator in contact with a rotatable roll such that edges of end seal assemblies of said applicator abut and extend along ends of said rotatable roll;

contacting said rotatable roll at a first location with a first, longitudinally extending trailing edge doctor blade;

contacting said rotatable roll at a second location with a second, longitudinally extending trailing edge doctor blade;

adjusting a sealing pressure to provide for an encapsulated applicator chamber between said fluid applicator and said rotatable roll;

adjusting a wiping pressure of said first trailing edge doctor blade;

delivering fluid to said applicator chamber defined between said fluid applicator and said transfer roll;

transferring said printing fluid from said chamber to a peripheral surface of said roll;

metering said printing fluid on said peripheral surface of said roll at said first location; and wiping contaminants and paper dust from said peripheral surface of said roll at said second location;

wherein said end seals have arcuate edges, and said positioning step includes pneumatically moving a carriage connected to said applicator along rods and sealingly engaging said arcuate edges of said end seals against outer sealing surfaces of said roll.

* * * * *